US010388242B2

(12) United States Patent
Kim et al.

(10) Patent No.: US 10,388,242 B2
(45) **Date of Patent: *Aug. 20, 2019**

(54) DISPLAY APPARATUS AND METHOD FOR DRIVING THE SAME

(71) Applicant: SAMSUNG DISPLAY CO., LTD., Yongin-si, Gyeonggi-do (KR)

(72) Inventors: Jung-Taek Kim, Seoul (KR); Joon-Chul Goh, Hwaseong-si (KR); Sang-Ik Lee, Seoul (KR); Kyoung-Ho Lim, Suwon-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/040,023

(22) Filed: Jul. 19, 2018

(65) Prior Publication Data

US 2018/0330689 A1 Nov. 15, 2018

Related U.S. Application Data

(63) Continuation of application No. 14/735,388, filed on Jun. 10, 2015, now Pat. No. 10,062,347.

(30) Foreign Application Priority Data

Jul. 16, 2014 (KR) ..... 10-2014-0089986

(51) Int. Cl.
*G09G 3/36* (2006.01)

(52) U.S. Cl.
CPC ..... *G09G 3/3677* (2013.01); *G09G 3/3666* (2013.01); *G09G 2300/0426* (2013.01);
(Continued)

(58) Field of Classification Search
CPC .. G09G 3/2937; G09G 3/2029; G09G 3/3648; G09G 2310/021; G09G 2310/006; G09G 2310/0251
See application file for complete search history.

(56) References Cited

U.S. PATENT DOCUMENTS 9,607,581 B2 * 3/2017 Park ..... G09G 5/18
2006/0050563 A1 3/2006 Lee
(Continued)

FOREIGN PATENT DOCUMENTS

KR 1020060063306 6/2006
KR 1020060078675 7/2006
(Continued)

*Primary Examiner* — Robert J Michaud
(74) *Attorney, Agent, or Firm* — F. Chau & Associates, LLC

(57) ABSTRACT

A display apparatus includes a display panel and a first gate driver. The display panel includes a plurality of data lines extending in a first direction, and a plurality of gate lines extending in a second direction obliquely inclined toward the first direction and spaced apart from each other in a third direction crossing the second direction. The plurality of gate lines includes a first gate line group and a second gate line group respectively disposed in first and second display areas of the display panel. The first gate driver is configured to drive at least one gate line of the second gate line group while driving at least one gate line of the first gate line group.

20 Claims, 13 Drawing Sheets

(52) U.S. Cl.
CPC ..... *G09G 2310/021* (2013.01); *G09G 2310/0264* (2013.01); *G09G 2310/08* (2013.01); *G09G 2320/02* (2013.01)

(56) References Cited

U.S. PATENT DOCUMENTS

| | | | | |
|---|---|---|---|---|
| 2006/0077027 | A1* | 4/2006 | Aoki ..... | G01R 33/383 335/306 |
| 2006/0164350 | A1 | 7/2006 | Kim et al. | |
| 2008/0084407 | A1 | 4/2008 | Hashikawa | |
| 2014/0375922 | A1 | 12/2014 | Park et al. | |
| 2016/0019852 | A1 | 1/2016 | Kim et al. | |

FOREIGN PATENT DOCUMENTS

| | | |
|---|---|---|
| KR | 1020080004851 | 1/2008 |
| KR | 1020110042674 | 4/2011 |
| KR | 1020150133934 | 12/2015 |

* cited by examiner

DISPLAY APPARATUS AND METHOD FOR DRIVING THE SAME

CROSS-REFERENCE TO RELATED APPLICATIONS

This application is a continuation of U.S. application Ser. No. 14/735,388, filed on Jun. 10, 2015, which claims priority under 35 U.S.C. § 119 to Korean Patent Application No. 10-2014-0089986, filed on Jul. 16, 2014, the disclosure of which is incorporated by reference herein in its entirety.

TECHNICAL FIELD

Exemplary embodiments of the present invention relate to a display apparatus and a method of driving the display apparatus. More particularly, exemplary embodiments of the present invention relate to a display apparatus capable of improving display quality, and a method of driving the display apparatus.

DISCUSSION OF THE RELATED ART

A liquid crystal display apparatus typically includes a first substrate including a pixel electrode, a second substrate including a common electrode and a liquid crystal layer interposed between the first and second substrates. A voltage is applied to the pixel electrode and the common electrode to form an electric field in the liquid crystal layer. The intensity of the electric field is changed to adjust the transmittance of light passing through the liquid crystal layer to display a desired image.

The display apparatus includes a peripheral area, on which a gate driver and a data driver are disposed. An image is not displayed on the peripheral area, which may also be referred to as a bezel. When the size of the bezel is increased, the display area of the display apparatus may look relatively small.

SUMMARY

Exemplary embodiments of the present invention provide a display apparatus including a reduced bezel and capable of improving display quality.

Exemplary embodiments of the present invention further provide a method for driving the display apparatus.

According to an exemplary embodiment of the present invention, a display apparatus includes a display panel and a first gate driver. The display panel include a plurality of data lines extending in a first direction, a first gate line group including a plurality of gate lines extending in a second direction obliquely inclined toward the first direction and arranged to be spaced apart from each other in a third direction crossing the second direction, and a second gate line group including a plurality of gate lines extending in the third direction. The first gate line group overlaps with a first display area, and the second gate line group overlaps with a second display area. The first gate driver is configured to drive at least one gate line of the second gate line group while driving the gate lines of the first gate line group.

In an exemplary embodiment, the first gate driver is configured to sequentially drive the gate lines of the first gate line group for a first period, and to sequentially drive the gate lines of the second gate line group for a second period, of which at least a portion overlaps with the first period.

In an exemplary embodiment, the first gate driver is configured to simultaneously output gate signals to at least one gate line of the first gate line group and at least one gate line of the second gate line group for a period in which the first period overlaps with the second period.

In an exemplary embodiment, the first gate driver is configured to drive the gate lines of the first gate line group and the second gate line group in the third direction.

In an exemplary embodiment, the first gate driver is configured to drive the gate lines of the first gate line group and the second gate line group in a direction opposite to the third direction.

In an exemplary embodiment, the first gate driver is alternately connected to the gate lines of the first gate line group and the gate lines of the second gate line group at a first longer side of the display panel.

In an exemplary embodiment, the gate lines of the second gate line group are electrically connected to the first gate driver through gate sub-lines extending in the first direction.

In an exemplary embodiment, the gate sub-lines are connected to the first gate driver at the first longer side, and the gate sub-lines are connected to the gate lines of the second gate line group at a second longer side of the display panel, which is opposite to the first longer side.

In an exemplary embodiment, each of the gate lines of the first and second gate line groups includes a plurality of unit portions, each of the unit portions including a first portion extending in the first direction and a second portion extending in a fourth direction crossing the first direction. The unit portions are continuously connected to each other in the second direction.

In an exemplary embodiment, the display panel further includes a plurality of pixel units arranged in a matrix configuration, and each of the pixel units is electrically connected to an adjacent gate line and an adjacent data line.

In an exemplary embodiment, the display apparatus further includes a second gate driver. The display panel further includes a third gate line group including a plurality of gate lines extending in the second direction and arranged to be spaced apart from each other in the third direction. The third gate line group overlaps with a third display area. The second gate driver is configured to drive the gate lines of the third gate line group.

In an exemplary embodiment, the second gate driver is configured to sequentially drive the gate lines of the third gate line group for a third period, of which at least a portion overlaps with the first period.

In an exemplary embodiment, the display apparatus further includes a data driver. The data driver and the first gate driver are disposed adjacent to a first longer side of the display panel.

According to an exemplary embodiment of the present invention, a method for driving a display apparatus is provided. According to the method, gate lines of a first gate line group disposed in a first display area of a display panel are sequentially driven for a first period. Gate lines of a second gate line group disposed in a second display area of the display panel are sequentially driven for a second period, of which at least a portion overlaps with the first period.

In an exemplary embodiment, at least one gate line of the first gate line group and at least one gate line of the second gate line group simultaneously receive a gate signal for a period in which the first period overlaps with the second period.

In an exemplary embodiment, the display panel includes data lines extending in a first direction. The gate lines of the first and second gate line groups extend in a second direction obliquely inclined toward the first direction.

In an exemplary embodiment, the gate lines of the first gate line group and the gate lines of the second gate line group are alternately connected to a first gate driver configured to receive gate signals. The gate lines of the second gate line group are electrically connected to the first gate driver through gate sub-lines extending in the first direction.

In an exemplary embodiment, gate lines of a third gate line group disposed in a third display area of the display panel are sequentially driven for a third period, of which at least a portion overlaps with the first period. The first display area is disposed between the second display area and the third display area. The gate lines of the third gate line group are connected to a second gate driver gate driver configured to receive gate signals.

In an exemplary embodiment, gate lines of a fourth gate line group disposed in a fourth display area of the display panel, which is disposed between the first display area and the third display area, are sequentially driven for a fourth period continuous to the third period. Gate lines of a fifth gate line group disposed in a fifth display area of the display panel, which is disposed between the first display area and the second display area, are sequentially driven for a fifth period continuous to the first period. The gate lines of the fourth gate line group and the gate lines of the fifth gate line group are alternately connected to a third gate driver configured to receive gate signals. The gate lines of the fifth gate line group are electrically connected to the third gate driver through gate sub-lines extending in the first direction.

In an exemplary embodiment, the first gate driver sequentially drives the gate lines of the second gate line group after driving at least one gate line of the first gate line group.

According to an exemplary embodiment of the present invention, a display panel includes a plurality of data lines extending in a first direction, and a plurality of gate lines extending in a second direction obliquely inclined toward the first direction and spaced apart from each other in a third direction crossing the second direction. The plurality of gate lines includes a first gate line group and a second gate line group. The first gate line group is disposed in a first display area of the display panel, and the second gate line group is disposed in a second display area of the display panel. The display panel further includes a first gate driver configured to drive at least one gate line of the second gate line group while driving at least one gate line of the first gate line group (e.g., the first gate driver is configured to drive at least one gate line of the second gate line group and at least one gate line of the first gate line group simultaneously (e.g., at substantially the same time)).

According to an exemplary embodiment of the present invention, a method of driving a display apparatus includes driving at least one gate line of a first gate line group of a plurality of gate lines and at least one gate line of a second gate line group of the plurality of gate lines at substantially a same time (e.g., simultaneously). The plurality of gate lines and a plurality of data lines are disposed in a display panel, the plurality of data lines extends in a first direction, the plurality of gate lines extends in a second direction obliquely inclined toward the first direction, and are spaced apart from each other in a third direction crossing the second direction, and the first gate line group is disposed in a first display area of the display panel and the second gate line group is disposed in a second display area of the display panel.

According to exemplary embodiments of the present invention, gate lines extend in an obliquely inclined direction to reduce a bezel of a display apparatus. Further, the gate lines may be divided into a plurality of groups and driven simultaneously. Thus, the charging time for a pixel may be increased, and display quality may be improved.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EXEMPLARY EMBODIMENTS

Figure 1:
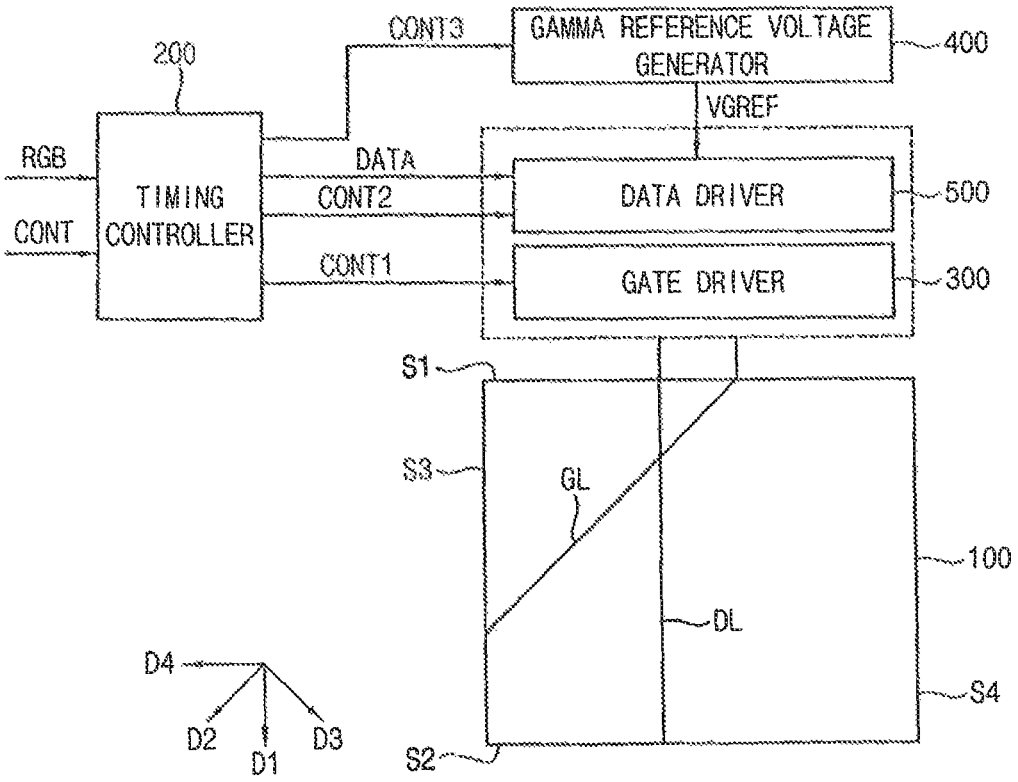
FIG. 1 is a block diagram illustrating a display apparatus according to an exemplary embodiment of the present invention.

Exemplary embodiments of the present invention will be described more fully hereinafter with reference to the accompanying drawings. Like reference numerals may refer to like elements throughout the accompanying drawings.

It will be understood that although the terms 'first' and 'second' may be used herein to describe various components, these components should not be limited by these terms. It will be further understood that when a component is referred to as being 'on', 'connected to', 'coupled to', or 'adjacent to' another component, it can be directly on, connected to, coupled to, or adjacent to the other component, or intervening components may also be present. It will also be understood that when a component is referred to as being 'between' two components, it can be the only component between the two components, or one or more intervening components may also be present. Herein, when two directions are referred to as crossing each other, the two directions may be substantially perpendicular to each other.

Figure 2:
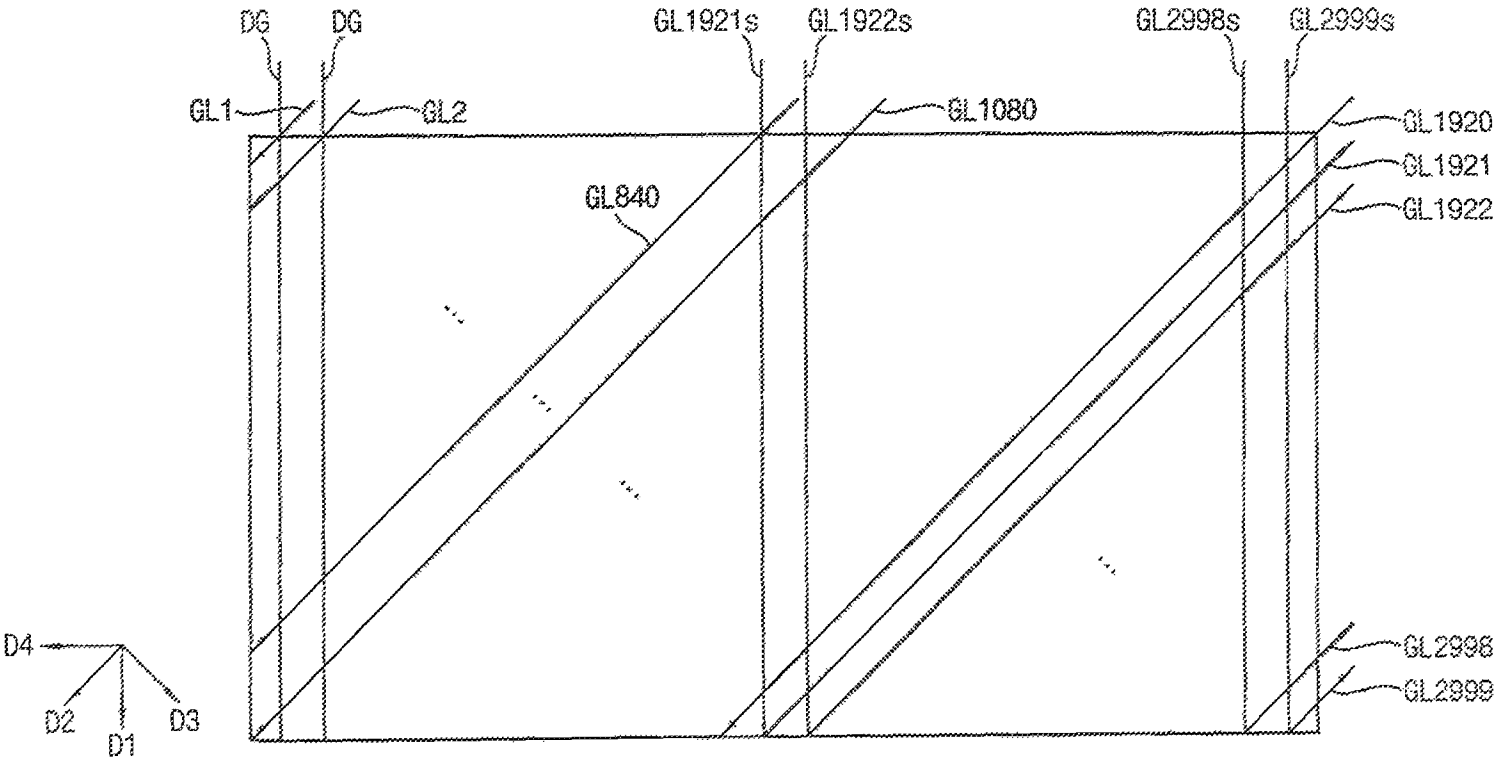
FIG. 2 is a schematic plan view illustrating gate lines of the display panel of the display apparatus of FIG. 1 according to an exemplary embodiment of the present invention.
Figure 3:
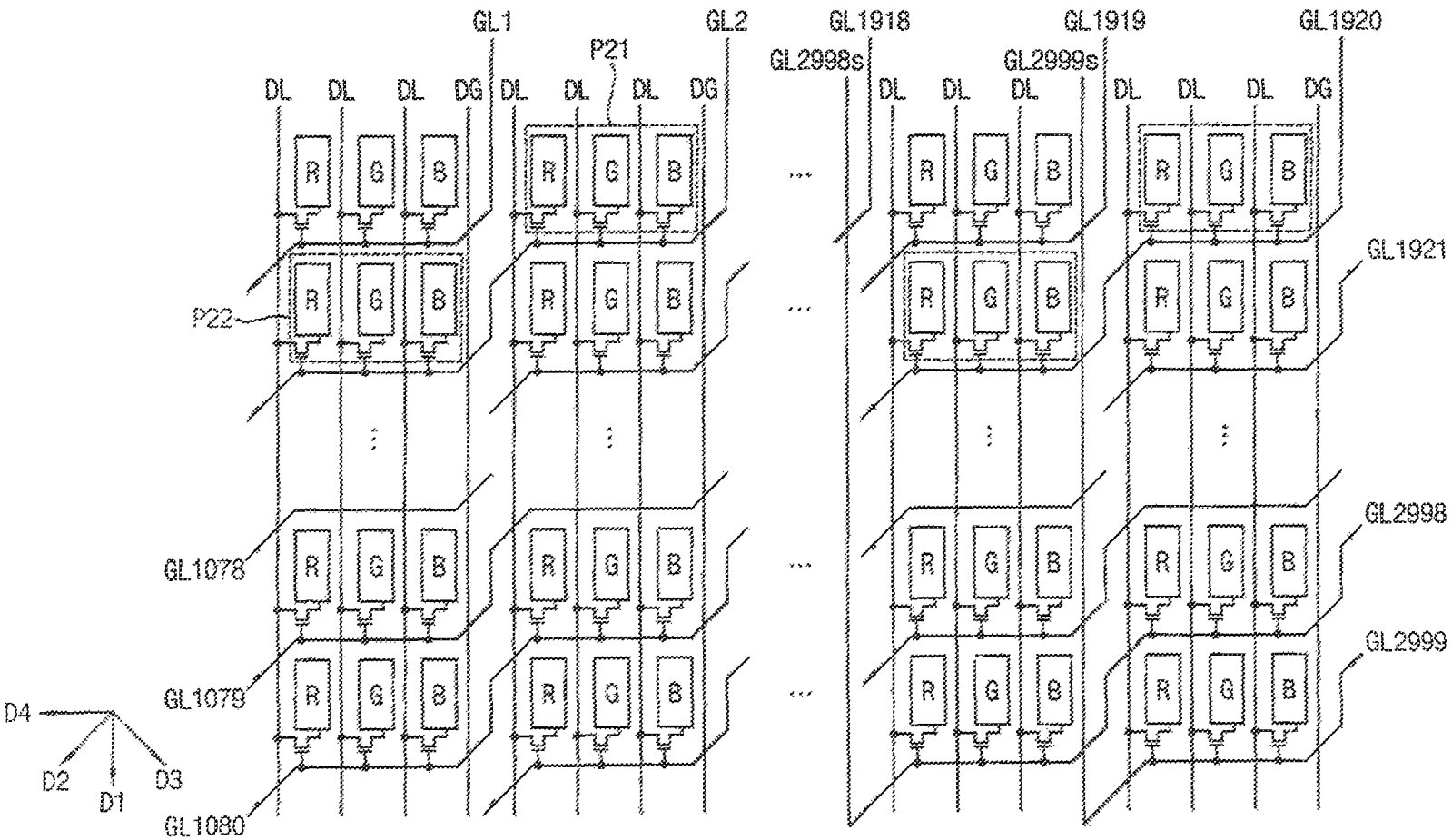
FIG. 3 is a schematic plan view illustrating the arrangement of pixels, data lines and gate lines of the display panel of the display apparatus of FIG. 1 according to an exemplary embodiment of the present invention.

FIG. 1 is a block diagram illustrating a display apparatus according to an exemplary embodiment of the present invention. FIG. 2 is a schematic plan view illustrating gate lines of the display panel of the display apparatus of FIG. 1 according to an exemplary embodiment of the present invention. FIG. 3 is a schematic plan view illustrating the arrangement of pixels, the data lines and the gate lines of the display panel of the display apparatus of FIG. 1 according to an exemplary embodiment of the present invention.

Referring to FIGS. 1 to 3, a display apparatus according to an exemplary embodiment includes a display panel 100 and a panel driver. The panel driver includes a timing controller 200, a gate driver 300, a gamma reference voltage generator 400 and a data driver 500.

The display panel 100 includes a display area in which an image is displayed and a peripheral area adjacent to the display area.

The display panel 100 includes a plurality of gate lines GL, a plurality of data lines DL and a plurality of pixel units electrically connected to the gate lines GL and the data lines DL. The data lines DL extend in a first direction D1 and are arranged to be spaced apart from each other in a direction crossing the first direction D1.

The gate lines GL extend in a second direction D2 obliquely inclined toward the first direction D1, and are arranged to be spaced apart from each other in a third direction D3 crossing the second direction D2. Each of the gate lines GL may include a plurality of unit portions including a first portion extending in the first direction D1, and a second portion extending in a fourth direction D4 crossing the first direction D1. The unit portions may be continuously connected to each other in the second direction D2. That is, the first portions may be connected to the second portions by a connecting portion extending in the second direction D2. Herein, the gate lines GL may be referred to as extending in the second direction D2 (e.g., the gate lines GL may be referred to as extending in the direction of the connecting portions).

The display panel 100 described hereinafter has a resolution of 1920×1080, however, it is to be understood that exemplary embodiments are not limited thereto. The display panel 100 includes a first longer side S1 crossing the first direction D1, a second longer side S2 opposite to the first longer side, a first shorter side S3 crossing the first longer side, and a second shorter side S4 opposite to the first shorter side.

The number of gate lines GL included in the display panel 100 may be equal to [a horizontal resolution+a vertical resolution−1]. Thus, the number of gate lines GL may be 2,999. However, it is to be understood that exemplary embodiments are not limited thereto.

In an exemplary embodiment a first gate line GL1 to a 1,920th gate line GL1920 extend from the first longer side S1 of the display panel 100 in the second direction D2. For example, the first gate line GL1 to a 1,080th gate line GL1080 extend from the first longer side S1 to the first shorter side S3 in the second direction D2. A 1,081th gate line to the 1,920th gate line GL1920 extend from the first longer side S1 to the second shorter side S4 in the second direction D2. Thus, ends of the first gate line GL1 to the 1,080th gate line GL1080 are disposed adjacent to the first longer side S1, and opposing ends of the first gate line GL1 to the 1,080th gate line GL1080 are disposed adjacent to the first shorter side S3. Ends of the 1,081th gate line GL1 to the 1,920th gate line GL1920 are disposed adjacent to the first longer side S1, and opposing ends of the 1,081th gate line to the 1,920th gate line GL1920 are adjacent to the second shorter side S4.

The 1,921th gate line GL1921 to a 2,999th gate line GL2999 extend from the second shorter side S4 in the second direction D2. For example, the 1,921th gate line GL1921 to the 2,999th gate line GL2999 extend from the second shorter side S4 to the second longer side S2 in the second direction D2. Thus, ends of the 1,921th gate line GL1921 to the 2,999th gate line GL2999 are disposed adjacent to the second shorter side S4, and opposing ends of the 1,921th gate line GL1921 to the 2,999th gate line GL2999 are disposed adjacent to the second longer side S2.

Each of the 1,921th gate line GL1921 to the 2,999th gate line GL2999 may include a gate sub-line extending in the first direction D1. For example, the 1,921th gate line GL1921 to the 2,999th gate line GL2999 are electrically connected to gate sub-lines GL1921*s*, GL1922*s*, . . . , GL2999*s*, respectively, in an area adjacent to the second longer side S2.

The gate lines GL are electrically connected to the gate driver 300 in an area adjacent to the first longer side S1. For example, ends of the first gate line GL1 to the 1,920th gate line GL1920 are connected to the gate driver 300. The 1,921th gate line GL1921 to the 2,999th gate line GL2999 may be electrically connected to the gate driver 300, which is adjacent to the first longer side S1, through the gate sub-lines GL1921*s*, GL1922*s*, . . . . GL2999*s*.

The display panel 100 may further include a plurality of dummy lines DG extending in the first direction D1 and arranged to be spaced apart from each other in the fourth direction D4. The dummy lines DG may be disposed in an area in which the gate sub-lines GL1921*s*, GL1922*s*, . . . , GL2999*s* are not disposed.

Each of the pixel units may include a plurality of sub-pixels. For example, the pixel units may include a red sub-pixel R a green sub-pixel G and a blue sub-pixel B.

Each of the sub-pixels may include a switching element, a liquid crystal capacitor electrically connected to the switching element and a storage capacitor. The sub-pixels may be disposed in a matrix configuration.

The pixel units are electrically connected to adjacent gate lines GL. For example, each of the pixel units may be electrically connected to a second portion of a unit portion of an adjacent gate line.

For example, a red sub-pixel R, a green sub-pixel G and a blue sub-pixel B of a pixel unit P21 in a first row and a second column may be electrically connected to a second portion of a first unit area of the second gate line GL2. A red sub-pixel R, a green sub-pixel G and a blue sub-pixel B of a pixel unit P22 in a second row and a first column may be electrically connected to a second portion of a second unit area of the second gate line GL2.

The pixel units are electrically connected to adjacent data lines DL. It is to be understood that the direction in which the pixels units are electrically connected to adjacent data lines DL is not limited to the exemplary embodiment described with reference to FIGS. 1 to 3.

The timing controller 200 receives input image data RGB and an input control signal CONT from an external device. The input image RGB may include, for example, red image data R, green image data G and blue image data B. The input control signal CONT may include, for example, a master clock signal and a data enable signal. The input control signal CONT may further include, for example, a vertical sync signal and a horizontal sync signal.

The timing controller 200 generates a first control signal CONT1, a second control signal CONT2, a third control signal CONT3 and a data signal DATA based on the input image data RGB and the input control signal CONT.

The first control signal CONT1 controls operation of the gate driver 300 based on the input control signal CONT and outputs the first control signal CONT1 to the gate driver 300. The first control signal CONT1 may include, for example, a vertical start signal and a gate clock signal.

The second control signal CONT2 controls operation of the data driver 500 based on the input control signal CONT and outputs the second control signal CONT2 to the data driver 500. The second control signal CONT2 may include, for example, a horizontal start signal and a load signal.

The timing controller 200 generates the data signal DATA based on the input image data RGB. The timing controller 200 outputs the data signal DATA to the data driver 500.

The third control signal CONT3 controls operation of the gamma reference voltage generator 400 based on the input control signal CONT and outputs the third control signal CONT3 to the gamma reference voltage generator 400.

The gate driver 300 generates gate signals, which may be gate-on signals, for driving the gate lines GL in response to the first control signal CONT1 provided by the timing controller 200. The gate driver 300 outputs the gate signals sequentially to the gate lines GL.

The display panel 100 may include a plurality of display areas, and the gate driver 300 may drive at lent two of the display areas simultaneously. The gate driver 300 may output gate signals sequentially to the gate lines GL included in each of the display areas. For example, the gate driver 300 may drive an n-th display area and an m-th display area simultaneously (where n and in are natural cambers different from each other). For example, the gate driver 300 may output gate signals sequentially to gate lines included in the m-th display area while simultaneously outputting gate signals sequentially to gate lines included in the n-th display area.

The gate driver 300 may be directly mounted on the display panel 100, or may be electrically connected to the display panel 100 via, for example, a tape carrier package (TCP). The gate driver 300 may be formed directly on the peripheral area of the display panel 100 with the switching element disposed in the display area.

The gate driver 300 may be disposed along and adjacent to the first longer side S1 of the display panel 100. The gate driver 300 may be electrically connected to the gate lines GL in an area adjacent to the first longer side S1.

The gamma reference voltage generator 400 generates a gamma reference voltage VGREF in response to receiving the third control signal CONT3 provided by the timing controller 200. The gamma reference voltage generator 400 provides the gamma reference voltage VGREF to the data driver 500. The gamma reference voltage VGREF has a value corresponding to each of the data signals DATA.

According to exemplary embodiments, the gamma reference voltage generator 400 may be disposed in the timing controller 200, in the data driver 500, or separate from the timing controller 200 and the data driver 500.

The data driver 500 receives the second control signal CONT2 and the data signal DATA from the timing controller 200, and receives the gamma reference voltage VGREF from the gamma reference voltage generator 400. The data driver 500 converts the data signal DATA to an analog data voltage by using the gamma reference voltage VGREF. The data driver 500 outputs the data voltage to the data line DL.

The data driver 500 may be directly mounted on the display panel 100, or may be electrically connected to the display panel 100 with a tape carrier package (TCP). The data driver 500 may be formed directly on the peripheral area of the display panel 100 with the switching element in the display area.

The data driver 500 may be disposed along and adjacent to the first longer side S1 of the display panel 100. The data driver 500 may be electrically connected to the data lines DL in an area adjacent to the first longer side S1.

In an exemplary embodiment, the gate driver 300 may be disposed adjacent to the data driver 500 in the area adjacent to the first longer side S1 of the display panel 100. Thus, the display apparatus may include a single-side-driving display panel including the gate driver 300 and the data driver 500, which are disposed adjacent to a same side.

Figure 4:
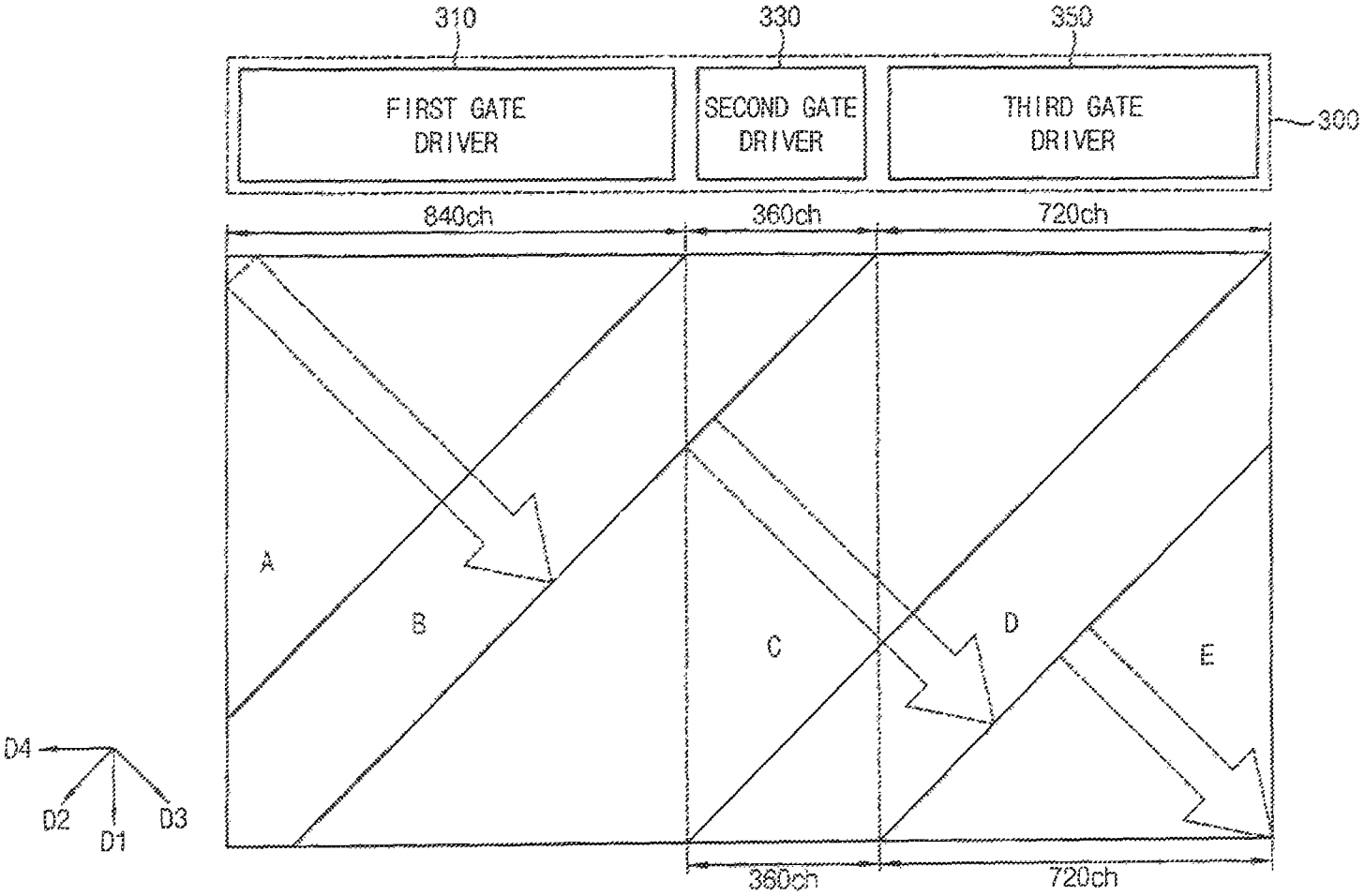
FIG. 4 is a block diagram illustrating a gate driver and a display panel according to an exemplary embodiment of the present invention.
Figure 5:
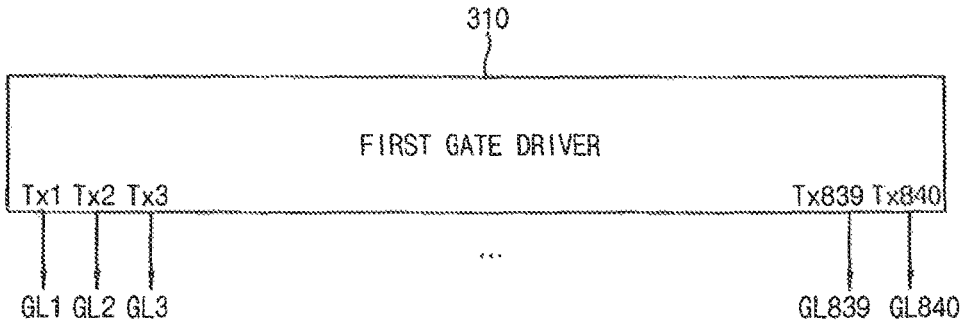
FIG. 5 is a block diagram illustrating a first gate driver of FIG. 4 according to an exemplary embodiment of the present invention.
Figure 6:
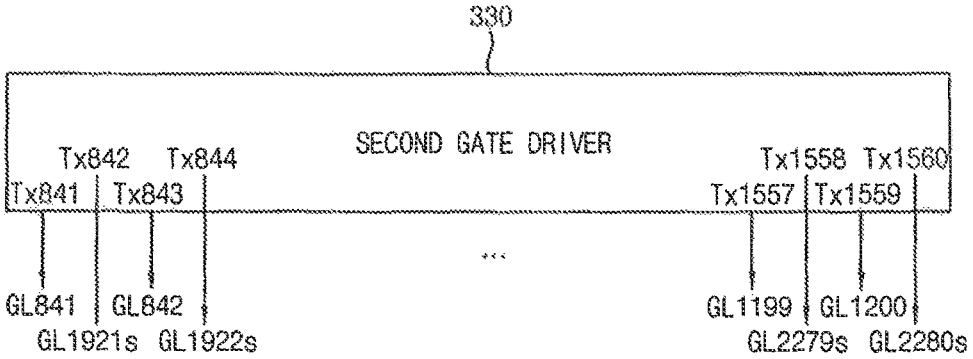
FIG. 6 is a block diagram illustrating a second gate driver of FIG. 4 according to an exemplary embodiment of the present invention.
Figure 7:
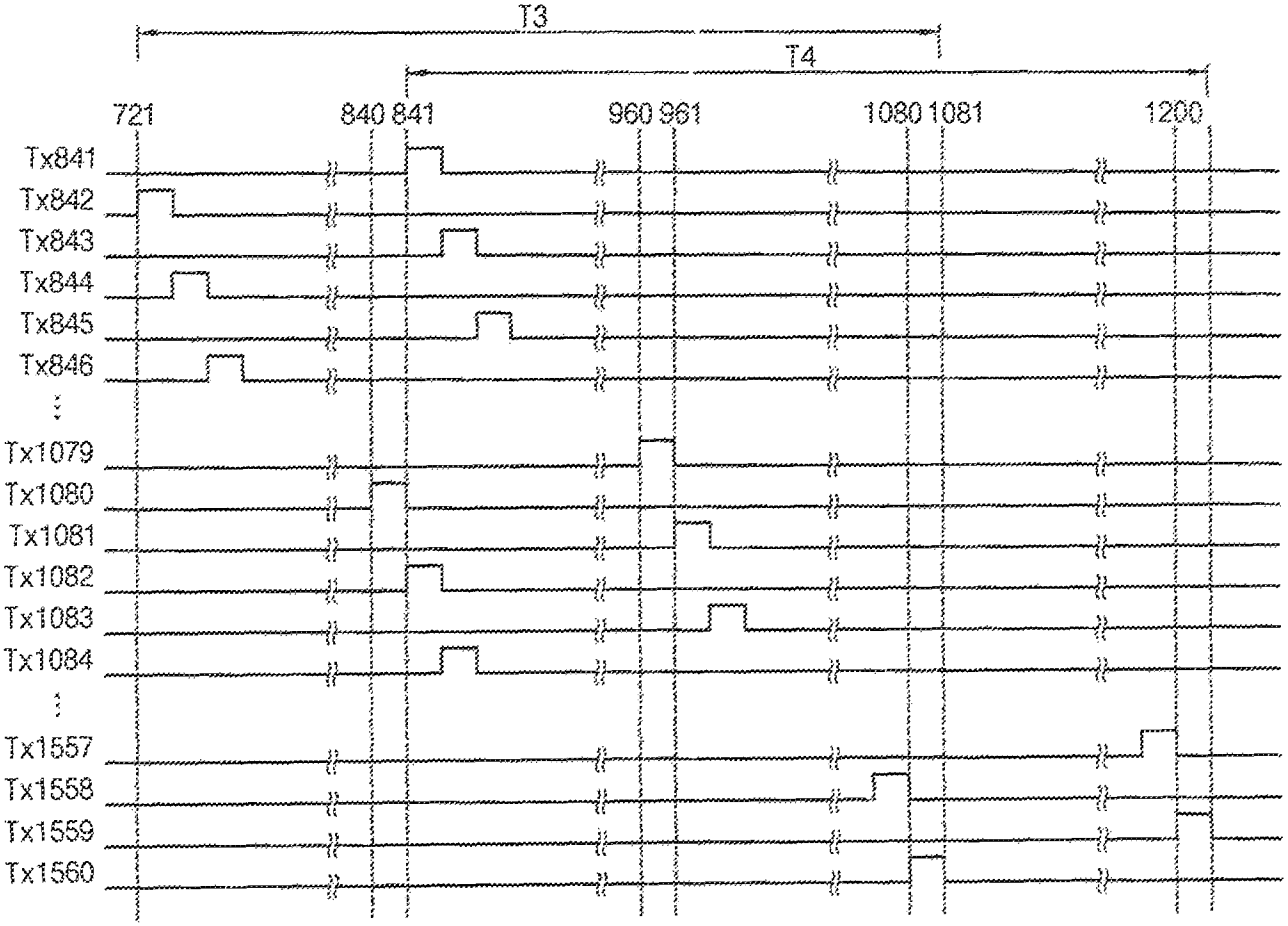
FIG. 7 is a waveform diagram illustrating gate signals of the second gate driver of FIG. 6 according to an exemplary embodiment of the present invention.
Figure 8:
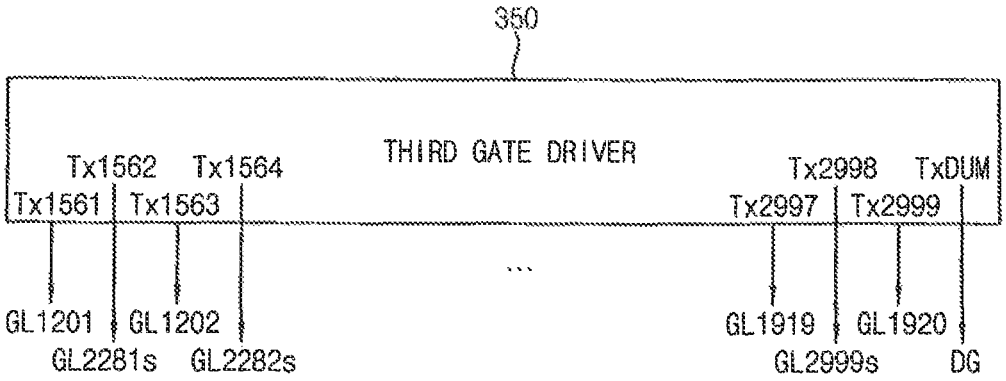
FIG. 8 is a block diagram illustrating a third gate driver of FIG. 4 according to an exemplary embodiment of the present invention.
Figure 9:
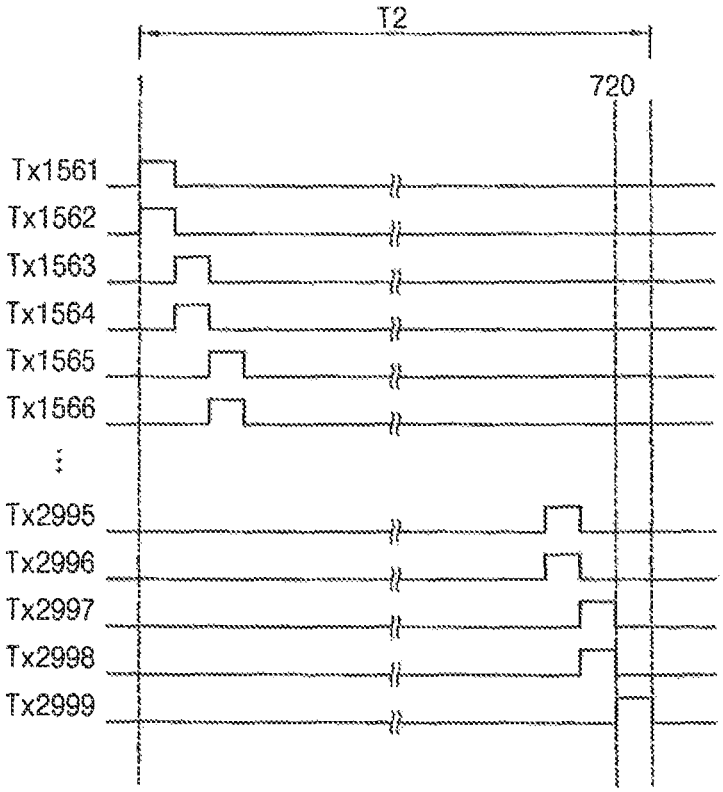
FIG. 9 is a waveform diagram illustrating gate signals of the third gate driver of FIG. 8 according to an exemplary embodiment of the present invention.
Figure 10:
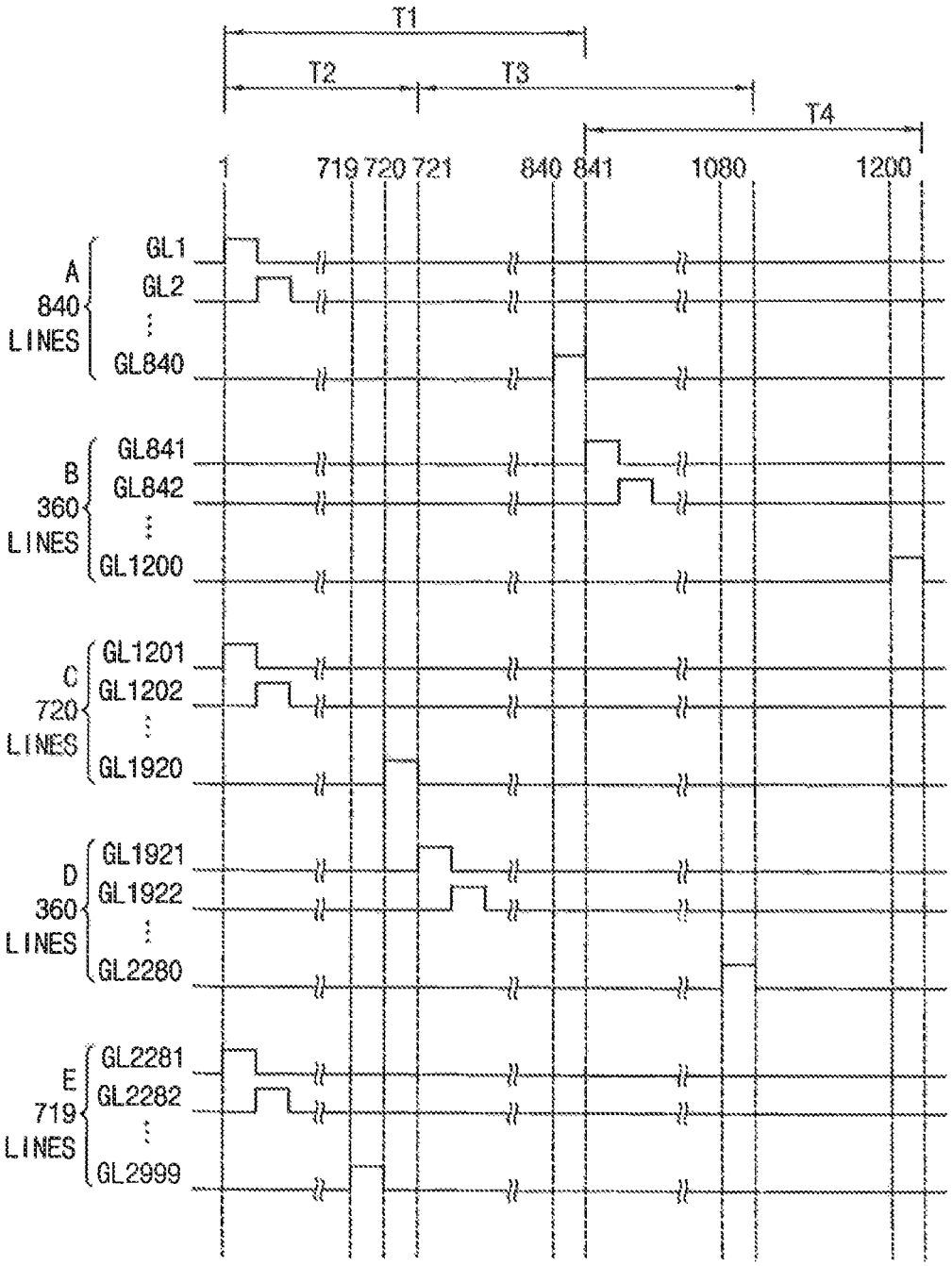
FIG. 10 is a waveform diagram illustrating gate signals of the third gate driver of FIG. 8 according to an exemplary embodiment of the present invention.

FIG. 4 is a block diagram illustrating a gate driver and a display panel according to an exemplary embodiment of the present invention. FIG. 5 is a block diagram illustrating the first gate driver of FIG. 4 according to an exemplary embodiment of the present invention. FIG. 6 is a block diagram illustrating the second gate driver of FIG. 4 according to an exemplary embodiment of the present invention. FIG. 7 is a waveform diagram illustrating gate signals of the second gate driver of FIG. 6 according to an exemplary embodiment of the present invention. FIG. 8 is a block diagram illustrating the third gate driver of FIG. 4 according to an exemplary embodiment of the present invention. FIG. 9 is a waveform diagram illustrating gate signals of the third gate driver of FIG. 8 according to an exemplary embodiment of the present invention. FIG. 10 is a waveform diagram illustrating gate signals of the third gate driver of FIG. 8 according to an exemplary embodiment of the present invention.

Referring to FIGS. 1 to 10, the display area of the display panel 100 may include a first display area A, a second display area B, a third display area C, a fourth display area D and a fifth display area E.

The gate lines CL may be divided into a first gate line group, a second gate line group, a third gate line group, a fourth gate line group, and a fifth gate line group.

The first gate line group may include the first gate line GL1 to the 840th gate line GL840. The first display area A may overlap the first gate line group. That is, the first display area A and the first gate line group may be disposed in the same area of the display panel 100 (e.g., the first display area A may correspond to the first gate line group).

The second gate line group may include the 841th gate line GL841 to the 1,200th gate line GL1200. The second display area B may overlap the second gate line group. That is, the second display area B and the second gate line group may be disposed in the same area of the display panel 100 (e.g., the second display area B may correspond to the second gate line group).

The third gate line group may include the 1,201th gate line GL1201 to the 1,920th gate line GL1920. The third display area C may overlap the third gate line group. That is, the third display area C and the third gate line group may be disposed in the same area of the display panel 100 (e.g., the third display area C may correspond to the third gate line group).

The fourth gate line group may include the 1,921th gate line GL1921 to the 2,280th gate line GL2280. The fourth display area D may overlap the fourth gate line group. That is, the fourth display area D and the fourth gate line group may be disposed in the same area of the display panel 100 (e.g., the fourth display area D may correspond to the fourth gate line group).

The fifth gate line group may include the 2,281th gate line GL2281 to the 2,999th gate line GL2999. The fifth display area E may overlap the fifth gate line group. That is, the fifth display area E and the fifth gate line group may be disposed in the same area of the display panel 100 (e.g., the fifth display area E may correspond to the fifth gate line group).

In an exemplary embodiment, the gate driver 300 may simultaneously drive the first display area A, the third display area C and the fifth display area E. For example, the gate driver 300 may drive the second display area B after completing driving the first display area A, and may drive the fourth display area D after completing driving the third display area C so that only one gate line is driven when a data voltage is applied to the data line DL.

The gate driver 300 may include a first gate driver 310 outputting gate signals to the first display area A, a second gate driver 330 outputting gate signals to the second display area B and the fourth display area D, and a third gate driver 350 outputting gate signals to the third display area C and the fifth display area E to simultaneously drive the first display area A, the third display area C and the fifth display area E. The first to third gate drivers 310, 330 and 350 may respectively receive a vertical start signal to simultaneously drive the first display area A, the third display area C and the fifth display area E.

The first gate driver 310 may be electrically connected to the first gate line group corresponding to the first display area A. The first gate driver 310 may include a first output terminal Tx1 to an 840th output terminal Tx840. The first output terminal Tx1 to the 840th output terminal Tx840 may be electrically connected to the gate lines GL1 to GL840 of the first gate line group, respectively.

The first gate driver 510 may sequentially output gate signals through the first output terminal Tx1 to the 840th output terminal Tx840. The first gate driver 310 may output the gate signals in a forward direction, which progresses from the first output terminal Tx1 to the 840th output terminal Tx840.

The second gate driver 330 may be electrically connected to the second gate line group corresponding to the second display area B, and the fourth gate line group corresponding to the fourth display area D. The second gate driver 330 may be alternately connected to the second gate line group and the fourth gate line group.

The second gate driver 330 may include an 841th output terminal Tx841 to a 1,560th output terminal Tx1560. Odd-numbered output terminals of the 841th output terminal Tx841 to the 1,560th output terminal Tx1560 may be electrically connected to the gate lines GL841 to GL1200 of the second gate line group, respectively. Even-numbered output terminals of the 841th output terminal Tx841 to the 1,560th output terminal Tx1560 may be electrically connected to the gate lines GL1921 to GL2280 of the fourth gate line group through the gate sub-lines GL1921*s* to GL2280*s*, respectively.

The second gate driver 330 may sequentially output gate signals through the odd-numbered output terminals of the 841th output terminal Tx841 to the 1,560th output terminal Tx1560. Further, the second gate driver 330 may sequentially output gate signals through the even-numbered output terminals of the 841th output terminal Tx841 to the 1,560th output terminal Tx1560. The second gate driver 330 may output the gate signals in a forward direction, which progresses from the 841th output terminal Tx841 to the 1,560th output terminal Tx1560.

The third gate driver 350 may be electrically connected to the third gate line group corresponding to the third display area C, and the fifth gate line group corresponding to the fifth display area E. The third gate driver 350 may be alternately connected to the third gate line group and the fifth gate line group.

The third gate driver 350 may include a 1,561th output terminal GL1561 to a 2,999th output terminal Tx2999. Odd-numbered output terminals of the 1,561th output terminal Tx1561 to the 2,999th terminal Tx2999 may be electrically connected to the gate lines GL1201 to GL1920 of the third gate line group, respectively. Even-numbered output terminals of the 1,561th output terminal Tx1561 to the 2,999th output terminal Tx2999 may be electrically connected to the gate lines GL2281 to GL2999 of the fifth gate line group through the gate sub-lines GL2281*s* to GL2999*s*, respectively. The third gate driver 350 may further include a dummy gate output terminal TxDUM electrically connected to a dummy line DG.

The third gate driver 350 may sequentially output gate signals through the odd-numbered output terminals of the 1,561th output terminal Tx1561 to the 2,999th output terminal Tx2999. Further, the third gate driver 350 may sequentially output gate signals through the even-numbered output terminals of the 1,561th output terminal Tx1561 to the 2,999th output terminal Tx2999. The third gate driver 350 may output the gate signals in a forward direction, which progresses from the 1,561th output terminal Tx1561 to the 2,999th output terminal Tx2999.

Each of the first gate driver 310, the second gate driver 330 and the third gate driver 350 may include a plurality of driving chips. For example, the first gate driver 310 may include three driving chips that may respectively include 360 channels. The second gate driver 330 may include two driving chips that may respectively include 360 channels. The third gate driver 350 may include four driving chips that may respectively include 360 channels. It is to be understood that the number of the driving chips and channels is not limited thereto. Each of the first gate driver 310, the second gate driver 330 and the third gate driver 350 may include driving chips that cover gate lines connected thereto. For example, each of the first gate driver 310, the second gate driver 330 and the third gate driver 350 may include a single driving chip.

The first gate driver 310 may sequentially drive the gate lines GL1 to GL840 of the first gate line group for a first period T1. The first period T1 may be a time required for applying gate signals sequentially to 840 gate lines.

The third gate driver 350 may sequentially drive the gate lines GL1201 to GL1920 of the third gate line group and the gate lines GL2281 to GL2999 of the fifth gate line group for a second period T2, of which at least a portion overlaps with the first period T1. For example, the third gate driver 350 may sequentially drive the gate lines GL1201 to GL1920 of the third gate line group through the odd-numbered output terminals of the 1,561th output terminal Tx1561 to the 2,999th output terminal Tx2999 for the second period T2. Further, the third gate driver 350 may sequentially drive the gate lines GL2281 to GL2999 of the fifth gate line group through the even-numbered output terminals of the 1,561th output terminal Tx1561 to the 2,999th output terminal Tx2999 for the second period T2. The second period T2 may be a time required for applying gate signals sequentially to 720 gate lines. Thus, the second period T2 may start from a same point as the first period T1, and may end prior to the first period T1.

The second gate driver 330 may sequentially drive the gate lines GL1921 to GL2280 of the fourth gate line group for a third period T3 that is continuous to the second period T2 (e.g., the third period T3 may begin when the second period T2 ends). For example, the second gate driver 330 may sequentially drive the gate lines GL1921 to GL2280 of the fourth gate line group through the even-numbered terminals of the 841th output terminal Tx841 to the 1560th terminal Tx1560 for the third period T3. The third period T3 may be a time required for applying gate signals sequentially to 360 gate lines.

The second gate driver 330 may sequentially drive the gate lines GL841 to GL1200 of the second gate line group for a fourth period T4 that is continuous to the first period T1 (e.g., the fourth period T4 may begin when the first period T1 ends). For example, the second gate driver 330 may sequentially drive the gate lines GL841 to GL1200 of the second gate line group through the odd-numbered output terminals of the 841th output terminal Tx841 to the 1,560th output terminal Tx1560 for the fourth period 14. The fourth period T4 may be a time required for applying gate signals sequentially to 360 gate lines. At least a portion of the fourth period T4 may overlap with the third period T3.

According to an exemplary embodiment, the first display area A, the third display area C and the fifth display area E start to be driven simultaneously. The first display area A is driven for the first period T1. The third display area C and the fifth display area E are driven for the second period T2. After the second period T2 (which is shorter than the first period T1) ends, the fourth display area D is driven for the third period T3. After the first period T1 ends, the second display area B is driven for the fourth period T4. A length of the third period T3 may be substantially the same as a length of the fourth period T4. When the fourth period T4 ends, the driving of all of the gate lines GL is completed. Thus, a time required for driving all of the gate lines GL of the display panel 100 may be reduced to be the sum of the first period T1 and the fourth period T4. Thus, a charging time for a pixel may be increased, which may improve the display quality of the display apparatus.

Figure 11:
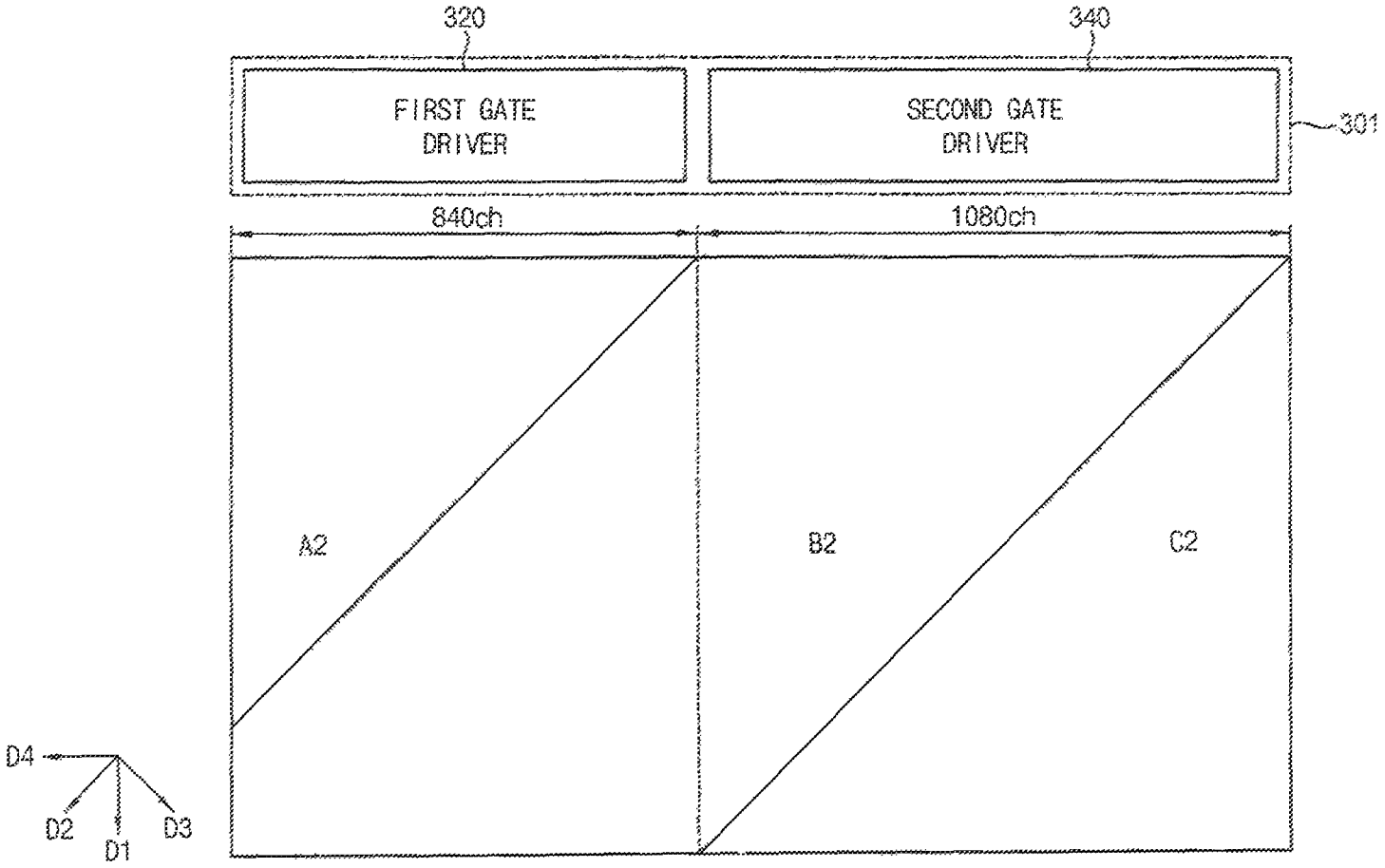
FIG. 11 is a block diagram illustrating a gate driver and a display panel according to an exemplary embodiment of the present invention.
Figure 12:
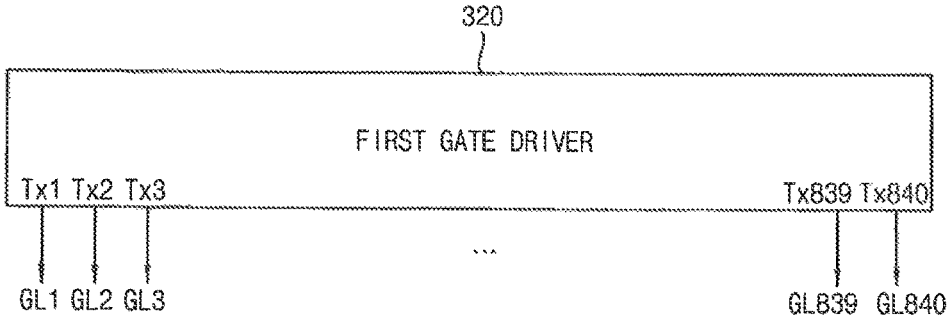
FIG. 12 is a block diagram illustrating a first gate driver of FIG. 11 according to an exemplary embodiment of the present invention.
Figure 13:
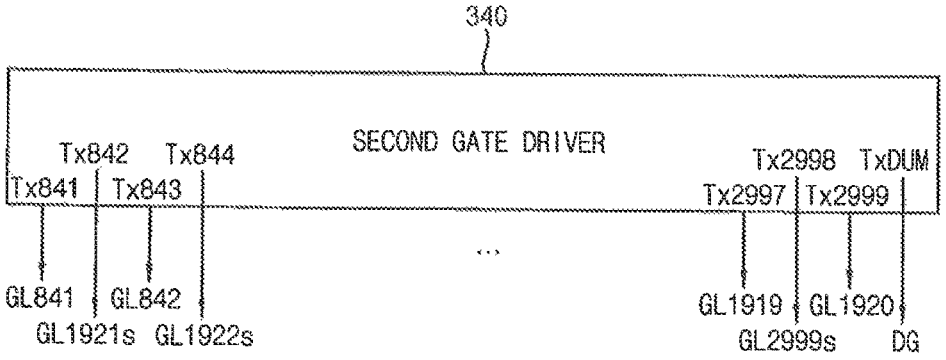
FIG. 13 is a block diagram illustrating a second gate driver of FIG. 11 according to an exemplary embodiment of the present invention.
Figure 14:
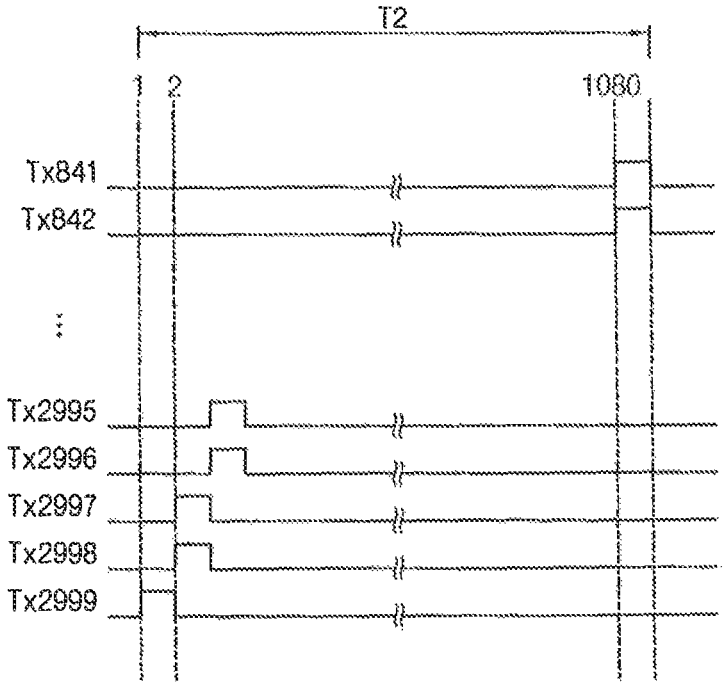
FIG. 14 is a waveform diagram illustrating gate signals of the second gate driver of FIG. 13 according to an exemplary embodiment of the present invention.
Figure 15:
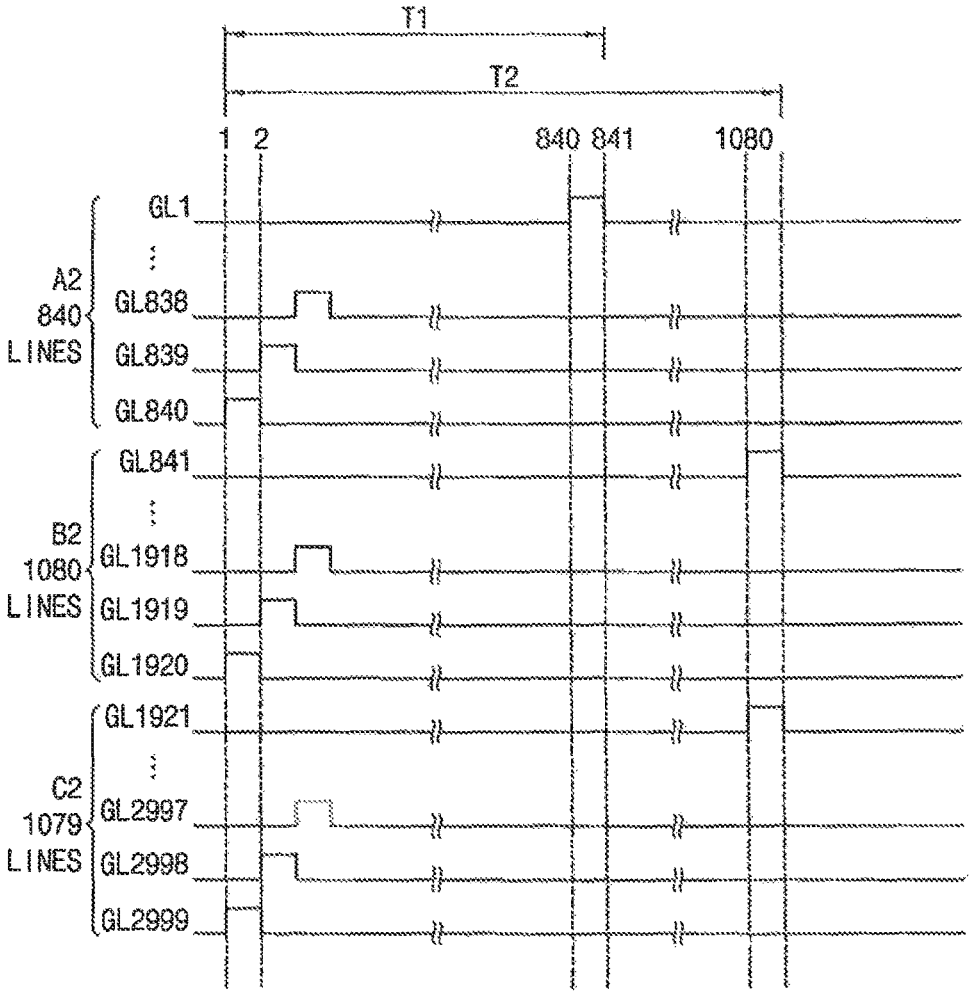
FIG. 15 is a waveform diagram illustrating the driving timing of gate lines according to an exemplary embodiment of the present invention.

FIG. 11 is a block diagram illustrating a gate driver and a display panel according to an exemplary embodiment of the present invention. FIG. 12 is a block diagram illustrating the first gate driver of FIG. 11 according to an exemplary embodiment of the present invention. FIG. 13 is a block diagram illustrating the second gate driver of FIG. 11 according to an exemplary embodiment of the present invention. FIG. 14 is a waveform diagram illustrating gate signals of the second gate driver of FIG. 13 according to an exemplary embodiment of the present invention. FIG. 15 is a waveform diagram illustrating the driving timing of gate lines according to an exemplary embodiment of the present invention.

A display apparatus according to an exemplary embodiment described with reference to FIGS. 11 to 15 is substantially the same as the display apparatus according to an exemplary embodiment described with reference to FIGS. 1 to 10 except for a gate driver 301 and a driving method thereof. Thus, the same reference numerals may be used for the same elements, and any duplicative description of elements may be omitted.

Referring to FIGS. 1 to 3 and 11 to 15, a display area of the display panel 100 according to an exemplary embodiment may be divided into a first display area A2, a second display area B2 and a third display area C2.

Gate lines GL may be divided into a first gate line group, a second line group and a third line group.

The first gate line group may include a first gate line GL1 to an 840th gate line GL840. The first display area A2 may overlap the first gate line group. That is, the first display area A2 and the first gate line group may be disposed in the same area of the display panel 100 (e.g., the first display area A2 may correspond to the first gate line group).

The second gate line group may include an 841th gate line GL841 to a 1,920th gate line GL1920. The second display area B2 may overlap the second gate line group. That is, the second display area B2 and the second gate line group may be disposed in the same area of the display panel 100 (e.g., the second display area B2 may correspond to the second gate line group).

The third gate line group may include a 1,921th gate line GL1921 to a 2,999th gate line GL2999. The third display area C2 may overlap the third gate line group. That is, the third display area C2 and the third gate line group may be disposed in the same area of the display panel 100 (e.g., the third display area C2 may correspond to the third gate line group).

The gate driver 301 may simultaneously drive the first display area A2, the second display area B2 and the third display area C2. For example, the gate driver 301 may drive the third display area C2 after driving a first gate line of the second display area B2 such that only one gate line is driven when a data voltage is applied to the data line DL.

The gate driver 300 may include a first gate driver 320 outputting gate signals to the first display area A2, and a second gate driver 340 outputting gate signals to the second display area B2 and the third display area C2, to simultaneously drive the first display area A2, the second display area B2 and the third display area C2. For example, the first and second gate drivers 320 and 340 may respectively receive a vertical start signal to simultaneously drive the first display area A2, the second display area B2 and the third display area C2.

The first gate driver 320 may be electrically connected to the first gate line group corresponding to the first display area A2. The first gate driver 320 may include a first output terminal Tx1 to an 840th output terminal Tx840. The first output terminal Tx1 to the 840th output terminal Tx840 may be electrically connected to the gate lines GL1 to GL840 of the first gate line group, respectively.

The first gate driver 320 may sequentially output gate signals through the first output terminal Tx1 to the 840th output terminal Tx840. The first gate driver 320 may output the gate signals in an inverse direction, which progress from the 840th terminal Tx840 to the first output terminal Tx1.

The second gate driver 340 may be electrically connected to the second gate line group corresponding to the second display area B2, and the third gate line group corresponding to the third display area C2. The second gate driver 340 may be alternately connected to the second gate line group and the third gate line group.

The second gate driver 340 may include an 841th output terminal Tx841 to a 2,999th output terminal Tx2999, and a dummy gate output terminal TxDUM. Odd-numbered output terminals of the 841th output terminal Tx841 to the 2,999th output terminal Tx2999 may be electrically connected to the gate lines GL841 GL1920 of the second gate line group, respectively. Even-numbered output terminals of the 841th output terminal Tx841 to the 2,999th output terminal Tx2999 may be electrically connected to the gate lines GL1921 to GL2999 of the third gate line group through the gate sub-lines GL1921*s* to GL2999*s*, respectively. The dummy gate output terminal TxDUM may be electrically connected to a dummy gate line DG.

The second gate driver 340 may sequentially output gate signals through the odd-numbered output terminals of the 841th output terminal Tx841 to the 2,999th output terminal Tx2999 in an inverse direction. Further, the second gate driver 340 may sequentially output gate signals through the even-numbered output terminals of the 841th output terminal Tx841 to the 2,999th output terminal Tx2999 in the inverse direction. The inverse direction progresses from the 2,999th output terminal Tx2999 to the 841th output terminal Tx841.

Each of the first gate driver 320 and the second gate driver 340 may include a plurality of driving chips. For example, the first gate driver 320 may include three driving chips that may respectively include 360 channels. The second gate driver 340 may include six driving chips that may respectively include 360 channels. It is to be understood that the number of the driving chips and channels is not limited thereto. Each of the first gate driver 320 and the second gate driver 340 may include driving chips that may cover gate lines connected thereto. For example, each of the first gate driver 320 and the second gate driver 340 may include a single driving chip.

The first gate driver 320 may sequentially drive the gate lines GL1 to GL840 of the first gate line group in the inverse direction for a first period T1. The first period T1 may be a time required for applying gate signals sequentially to 840 gate lines.

The second gate driver 340 may sequentially drive the gate lines GL841 to GL1920 of the second gate line group and the gate lines GL1921 to GL2999 of the third gate line group in the inverse direction for a second period T2, of which at least a portion overlaps with the first period T1.

For example, the second gate driver 340 may sequentially drive the gate lines GL841 to GL1920 of the second gate line group through the odd-numbered output terminals of the 841th output terminal Tx841 to the 2,999th output terminal Tx2999 the inverse direction for the second period T2. Further, the second gate driver 340 may sequentially drive the gate lines GL1921 to GL2999 of the third gate line group through the even-numbered output terminals of the 841th output terminal Tx841 to the 2,999th output terminal Tx2999 in the inverse direction for the second period T2.

The second gate driver 340 may output a gate signal to a 2,998th output terminal Tx2998 when outputting a gate signal to a 2,997th output terminal Tx2997 after outputting a gate signal to the 2,999th output terminal Tx2999. Thus, the third gate line group may be driven with one line of delay compared to the second gate line group.

The second period T2 may be a time required for applying gate signals sequentially to 1080 gate lines. Thus, the second period T2 may start at a same point as the first period T1, and may end after the first period T1.

According to an exemplary embodiment, the first display area A2 and the second display area B2 start to be driven simultaneously, and the third display area C2 is driven with one line of delay. The first display area A2 is driven for the first period T1. The second display area B2 and the third display area C2 are driven for the second period T2. Since the first period T1 is shorter than the second period T2, the driving of all of the gate lines GL is completed when the second period T2 ends. Thus, a time required for driving all of the gate lines GL of the display panel 100 may be reduced to be the second period T2. Thus, a charging time for a pixel may be increased, and the display quality of the display apparatus may be improved.

According to the exemplary embodiments of the present invention described above, a gate driver may simultaneously drive at least two gate lines. Thus, the time required for driving all of gate lines may be reduced, the charging time for a pixel may be increased, and the display quality of the display apparatus may be improved.

A display apparatus and a method of driving the display apparatus according to exemplary embodiments of the present invention may be used for various display apparatuses such as, for example, a display apparatus including a plurality of display panels used to display an image, a portable display apparatus including a mobile phone, a notebook computer, a tablet computer, etc., a fixed display apparatus including a television, a monitor for a desktop computer, a home appliance including a refrigerator, a washing machine or an air conditioner, etc.

While the present invention has been particularly shown and described with reference to the exemplary embodiments thereof, it will be understood by those of ordinary skill in the art that various changes in form and detail may be made therein without departing from the spirit and scope of the present invention as defined by the following claims.

What is claimed is:

1. A display apparatus, comprising:

a display panel comprising a plurality of data lines extending in a first direction, and a plurality of gate lines extending in a second direction obliquely inclined toward the first direction and spaced apart from each other in a third direction crossing the second direction, wherein the plurality of gate lines comprises a first gate line group and a second gate line group, the first gate line group is disposed in a first display area of the display panel in the second direction obliquely inclined toward the first direction, and the second gate line group is disposed in a second display area of the display panel in the second direction obliquely inclined toward the first direction; and a first gate driver configured to drive at least one gate line of the second gate line group in the second display area of the display panel while driving at least one gate line of the first gate line group in the first display area of the display panel, and wherein a first portion of a first gate line of the plurality of gate lines extends across the display panel at a first end from a first longer side of the display panel to a second end at a second longer side of the display panel, and a second portion of the first gate line extends across the display panel at a first end from the second longer side of the display panel to a second end at a first shorter side of the display panel, and wherein the second end of the first portion of the first gate line is connected to the first end of the second portion of the first gate line.

2. The display apparatus of claim 1, wherein the first gate driver is configured to sequentially drive the first gate line group for a first period and the second gate line group for a second period, wherein at least a portion of the second period overlaps the first period.

3. The display apparatus of claim 2, wherein the first gate driver is configured to simultaneously output gate signals to the at least one gate line of the first gate line group and the at least one gate line of the second gate line group during the portion of the second period that overlaps the first period.

4. The display apparatus of claim 2, wherein the first gate line group comprises a plurality of first group gate lines, and the second gate line group comprises a plurality of second group gate lines, and wherein the first gate driver is configured to drive the plurality of first group gate lines and the plurality of the second group gate lines in the third direction.

5. The display apparatus of claim 2, wherein the first gate line group comprises a plurality of first group gate lines, and the second gate line group comprises a plurality of second group gate lines, and wherein the first gate driver is configured to drive the plurality of first group gate lines and the plurality of second group gate lines in a direction opposite to the third direction.

6. The display apparatus of claim 1, wherein the first gate driver is alternately connected to the first gate line group and the second gate line group at the first longer side of the display panel.

7. The display apparatus of claim 6, wherein the second gate line group is electrically connected to the first gate driver through gate sub-lines extending in the first direction.

8. The display apparatus of claim 7, wherein the gate sub-lines are connected to the first gate driver at the first longer side of the display panel, and the gate sub-lines are connected to the second gate line group at the second longer side of the display panel opposite to the first longer side.

9. The display apparatus of claim 1, wherein each of the gate lines of the first and second gate line groups comprises a plurality of unit portions, wherein each of the unit portions comprises a first portion extending in the first direction, a second portion extending in a fourth direction crossing the first direction, and a connecting portion extending in the second direction and connecting the first portion of each of the unit portions and the second portion of each of the unit portions, wherein the unit portions are continuously connected to each other in the second direction.

10. The display apparatus of claim 9, wherein the display panel further comprises a plurality of pixel units arranged in a matrix configuration, and each of the pixel units is electrically connected to an adjacent gate line of the plurality of gate lines and an adjacent data line of the plurality of data lines.

11. A method of driving a display apparatus, comprising:

sequentially driving gate lines of a first gate line group of a plurality of gate lines disposed in a first display area of a display panel for a first period; and sequentially driving gate lines of a second gate line group of the plurality of gate lines disposed in a second display area of the display panel for a second period, wherein at least a portion of the second period overlaps the first period, wherein a first portion of a first gate line of the plurality of gate lines extends across the display panel at a first end from a first longer side of the display panel to a second end at a second longer side of the display panel, and a second portion of the first gate line extends across the display panel at a first end from the second longer side of the display panel to a second end at a first shorter side of the display panel, wherein the second end of the first portion of the first gate line is connected to the first end of the second portion of the first gate line.

12. The method of claim 11, wherein at least one gate line of the first gate line group and at least one gate line of the second gate line group simultaneously receive a gate signal during the portion of the second period that overlaps the first period.

13. The method of claim 11, wherein the display panel comprises a plurality of data lines extending in a first direction, and the gate lines of the first gate line group and the gate lines of the second gate line group extend in a second direction obliquely inclined toward the first direction.

14. The method of claim 13, wherein the gate lines of the first gate line group and the gate lines of the second gate line group are alternately connected to a first gate driver that is configured to receive gate signals, and the gate lines of the second gate line group are electrically connected to the first gate driver through gate sub-lines extending in the first direction.

15. The method of claim 14, further comprising:

sequentially driving gate lines of a third gate line group disposed in a third display area of the display panel for a third period, wherein at least a portion of the third period overlaps the first period, the first display area is disposed between the second display area and the third display area, and the gate lines of the third gate line group are connected to a second gate driver that is configured to receive the gate signals.

16. The method of claim 15, further comprising:

sequentially driving gate lines of a fourth gate line group disposed in a fourth display area of the display panel for a fourth period, wherein the fourth display area is disposed between the first display area and the third display area; and sequentially driving gate lines of a fifth gate line group disposed in a fifth display area of the display panel for a fifth period, wherein the fifth display area is disposed between the first display area and the second display area, wherein the gate lines of the fourth gate line group and the gate lines of the fifth gate line group are alternately connected to a third gate driver that is configured to receive the gate signals, and the gate lines of the fifth gate line group are electrically connected to the third gate driver through gate sub-lines extending in the first direction.

17. The method of claim 15, wherein the first gate driver sequentially drives the gate lines of the second gate line group after driving at least one gate line of the first gate line group.

18. A method of driving a display apparatus, comprising:

driving at least one gate line of a first gate line group of a plurality of gate lines and at least one gate line of a second gate line group of the plurality of gate lines at substantially a same time, wherein the plurality of gate lines and a plurality of data lines are disposed in a display panel, wherein the plurality of data lines extends in a first direction, wherein the plurality of gate lines extends in a second direction obliquely inclined toward the first direction, and are spaced apart from each other in a third direction crossing the second direction, wherein the first gate line group is disposed in a first display area of the display panel and the second gate line group is disposed in a second display area of the display panel, wherein a first portion of a first gate line of the plurality of gate lines extends across the display panel at a first end from a first longer side of the display panel to a second end at a second longer side of the display panel, and a second portion of the first gate line extends across the display panel at one end from the second longer side of the display panel to a second end at a first shorter side of the display panel, and wherein the second end of the first portion of the first gate line is connected to the first end of the second portion of the first gate line.

19. The method of claim 18, further comprising: driving the first gate line group for a first period and the second gate line group for a second period, wherein at least a portion of the second period overlaps the first period.

20. The method of claim 19, further comprising: simultaneously outputting gate signals to the at least one gate line of the first gate line group and the at least one gate line of the second gate line group during the portion of the second period that overlaps the first period.

* * * * *